US006103093A

United States Patent [19]

Nidola et al.

[11] Patent Number: 6,103,093

[45] Date of Patent: Aug. 15, 2000

[54] ANODE FOR OXYGEN EVOLUTION IN ELECTROLYTES CONTAINING MANGANESE AND FLUORIDES

[75] Inventors: Antonio Nidola; Ulderico Nevosi, both of Milan; Rubén Jacobo Ornelas, Giuliano Milanese; Federico Zioni, Trezzano, all of Italy

[73] Assignee: De Nora S.p.A., Italy

[21] Appl. No.: 09/149,958

[22] Filed: Sep. 9, 1998

[30] Foreign Application Priority Data

Sep. 17, 1997 [IT] Italy ..... MI97A2107

[51] Int. Cl.[7] ..... C25B 11/04

[52] U.S. Cl. ..... 205/625; 204/290 F; 204/291

[58] Field of Search ..... 204/290 F, 291; 205/560, 498, 619, 625; 429/41, 59

[56] References Cited

U.S. PATENT DOCUMENTS 4,003,817 1/1977 Bianchi et al. ..... 204/290 F 4,331,528 5/1982 Beer et al. ..... 204/290 F

*Primary Examiner*—Kathryn Gorgos
*Assistant Examiner*—Thomas H Parsons
*Attorney, Agent, or Firm*—Bierman, Muserlian and Lucas

[57] ABSTRACT

A new electrocatalytic coating to be applied onto a titanium matrix, suitable for oxygen evolution from acid electrolytes containing manganese and fluorides, comprising:

a) an external coating for oxygen evolution at controlled potential, immune to manganese electrochemical precipitation and capable of promoting the spontaneous removal of the same during operation, consisting of ruthenium and iridium as the major components (60–85%), tin and cobalt (2–10%) and titanium and tantalum at intermediate concentrations with respect to the previous groups of components.

b) an optional interlayer acting as an electroconductive system and protecting the titanium matrix against corrosion caused by fluorides, made of titanium and tantalum as the major components (<95%) and iridium (>5%) as the minor component.

At least part of the above elements are in the form of oxides.

8 Claims, No Drawings

ANODE FOR OXYGEN EVOLUTION IN ELECTROLYTES CONTAINING MANGANESE AND FLUORIDES

BACKGROUND OF THE INVENTION

1. Field of the Invention

The present invention concerns electrocatalytic coatings for oxygen-evolving anodes.

2. Description of the Related Art

The anodic materials of the prior art for the electrometallurgy of copper, zinc and cobalt are essentially of two types: lead alloys, and cobalt-silicon alloys (cobalt only). Industrial lead anodes are made of lead alloys containing one or more elements selected in the following group: I B, IV A and V A. In particular, the lead-silver (0.2–0.8%) anode is commonly used especially in the zinc electrometallurgy, while for the cobalt electrometallurgy different alloys are used, such as lead-antimony (2–6%), lead-silver (0.2–0.8%), lead-tin (5–10%). These materials are characterized by:

high anodic potentials, above 1.9 V (NHE).

lifetimes in the range of 1 to 3 years high electric resistivity and substantial electric disuniformity leading to the formation of thick solid layers of $PbSO_4$ (intermediate passivating layer) and $PbO_2$ (external electrocatalytic layer for oxygen evolution).

These characteristics involve the following drawbacks:

faradic efficiency loss (below 90% for zinc, and below 95% for cobalt)

uneven and dendritic aspect of the deposit contamination by lead of the produced metal.

The cobalt alloys, used for a part of the cobalt electrometallurgy, are substantially of three types characterized by the following compositions: cobalt-silicon (5–20%), cobalt-silicon (5–20%)-manganese (1.0–5.0%), cobalt-silicon (5–20%)-copper (0.5–2.5%).

The cobalt-silicon alloys, with respect to the lead alloys, are characterized by a longer lifetime but are affected by a higher electrical resistivity and brittleness, while the cobalt-silicon-copper alloys have a shorter lifetime and are all the same fragile.

As concerns cathode poisoning, this occurs only when copper alloys are used.

Table 1 summarizes some examples of general operating conditions of the prior art technology. Reference is made to the process for zinc and cobalt deposition.

In the electrolysis of solutions containing, besides the salt of the metal to be deposited, also significant quantities of manganese (5–20 g/l and more), two reactions take place at the anode, and precisely:

oxygen evolution: $2H_2O=4H+O_2+4e$ manganese dioxide deposition (parasitic reaction): $2Mn^{2+}+4H_2O=2MnO_2+8H^++4e$.

This anodic by-product is an electrically resistive oxide (resistivity equal or higher than that of the $PbO_2$–$PbSO_4$ mixture formed on lead anodes); as a consequence, its precipitation on the surface of the electrode, if compact and continuous with time, involves a progressive increase of the electrode potential, which negatively affects prior art electrodes. In industrial practice, to avoid or at least control this phenomenon, the anodes (lead alloys or cobalt alloys) are periodically cleaned by mechanical brushing carried out outside the electrolysis cell.

It is known that titanium electrodes, activated by conventional coatings based on tantalum and iridium oxides, when used in electrolytes containing manganese, are negatively affected by the same drawbacks as lead anodes, with the only difference that the mechanical cleaning is not applicable due to the insufficient mechanical stability of the coating. Therefore, possible alternatives to the mechanical removal of the $MnO_2$ have been considered, such as periodical washing outside the cell with reducing solutions such as $H_2O_2$; $H_2O_2$+nitrates or nitric acid; ferrous salts and nitrates, ferrous salts and sulphates, etc. or actions carried out in the cell, such periodical current reversal, periodical current interruption, scheduled shut-downs etc. As the results were either negative or unsuitable for industrial scale application, efforts have been focused on the spontaneous removal of manganese dioxide electrodeposited onto the anode directly in the electrolysis cell.

SUMMARY OF THE INVENTION

It is the main object of the present invention to provide for an anode capable of promoting the spontaneous and continuous removal of the manganese dioxide, $MnO_2$, formed by the aforementioned parasitic reaction, so that the growth in thick layers is prevented.

DETAILED DESCRIPTION

The anode of the invention comprises an electrocatalytic surface coating for oxygen evolution applied on a titanium matrix, suitable for operation at controlled potential. Option-

TABLE 1

| | | | Prior art operating materials Anode lifetime (years) | | | |
|---|---|---|---|---|---|---|
| Process | Electrolyte | Current Density A/m$^2$ | Pb—Sn | Pb—Ag | Co—Si Co—Si—Mn | Co—Si—Cu |
| Zinc | $Zn^{2+}$ (40–90 g/l)<br>$H_2SO_4$ (150–200 g/l)<br>Fluorides (50 ppm)<br>Manganese (2–8 g/l) | 300–500 | // | 2–4 | // | // |
| | $Zn^{2+}$ (40–90 g/l)<br>$H_2SO_4$ (150–200 g/l)<br>Fluorides (5 ppm)<br>Manganese (2–8 g/l) | 300–500 | 1–3 | 2–4 | // | // |
| Cobalt | $Co^{2+}$ (50–80 g/l)<br>$H_2SO_4$ (pH 1–3)<br>Manganese (10–30 g/l)<br>pH = 4–5,5 | 160–250 | 4–5 | 4–5 | 3–4 | 2–3 |

ally an inter-layer may be provided, which acts as an electroconductive system for protecting the titanium matrix (stabilizing action towards fluorides and acidity). The following complementary criteria are used for selecting the surface coating:

a) addition of highly catalytic metals for oxygen evolution, for example ruthenium and cobalt, to the main components consisting of tantalum and iridium, to fix the voltage at low and controlled values.

b) further addition of metals capable of stabilizing ruthenium and cobalt, such as titanium and tin.

The invention will be better illustrated making reference to some examples, which are not intended to limit the same.

For all of the Examples, the samples, consisting of a matrix made of titanium grade 1, having the dimensions of 40 mm×40 mm×2 mm, were prepared according to the following steps and control procedures:

I. surface treatment with corindone sand+pickling in 20% HCl for 30 minutes;

II. application of optional protective layers;

III. application of the surface electrocatalytic layer for oxygen evolution;

IV. electrochemical characterization tests (electrode potential) in electrolytic media simulating industrial process working conditions;

V. comparison with reference samples prepared according to prior art technologies.

EXAMPLE 1

27 reference samples have been prepared according to the prior art teachings. The titanium matrix was pre-treated as described above (step I). Then, 9 samples, identified as A, were activated with a surface coating based on Ta-Ir (65% by weight) (step III only); 9 samples, identified as B, were activated with an interlayer based on Ti-Ta (49% by weight) (step II) and, subsequently, with a surface coating of Ta-Ir (65% by weight) (step III) and 9 samples, identified as C were activated with an interlayer based on Ti-Ta (44% by weight)-Ir (12% by weight) (step II) and, subsequently, with a surface coating of Ta-Ir (65% by weight) (step III).

The compositions of the paints, interlayers and surface coatings are reported herebelow:

| | Paints for the interlayers | | Paints for the surface coatings | |
|---|---|---|---|---|
| | Components | mg/ml as metal | Components | mg/ml as metal |
| A | = | = | $TaCl_5$ $IrCl_3.3H_2O$ HCl | 50(Ta) 90(Ir) |
| B | $TiCl_3$ $TaCl_5$ HCl | 5,33(Ti) 5,03(Ta) | $TaCl_5$ $IrCl_3.3H_2O$ HCl | 50(Ta) 90(Ir) |
| C | $TiCl_3$ $TaCl_5$ $IrCl_3$ HCl | 5,00(Ti) 5,00(Ta) 1,36(Ir) | $TaCl_5$ $IrCl_3.3H_2O$ HCl | 50(Ta) 90(Ir) |

| | Interlayers | | | Surface coatings | | |
|---|---|---|---|---|---|---|
| | Components | % by weight as metal | $g/m^2$ as total metal | Components | % by weight as metal | $g/m^2$ as noble metal |
| A | = | = | = | $Ta_2O_5$—$IrO_2$ | 35(Ta) 65(Ir) | 10 |
| B | $Ta_2O_5$—$TiO_2$ | 50(Ta) 50(Ti) | 1 | $Ta_2O_5$—$IrO_2$ | 35(Ta) 65(Ir) | 10 |
| C | $Ta_2O_5$—$TiO_2$—$IrO_2$ | 44(Ta) 44(Ti) 12(Ir) | 2 | $Ta_2O_5$—$IrO_2$ | 35(Ta) 65(Ir) | 10 |

As regards the formation of the interlayer and surface coating, the paint was applied by brushing or equivalent technique. This procedure was repeated as many times as necessary to obtain the desired quantity of deposited metal. Between an interlayer and the other layer of applied paint, drying was carried out at 150° C., followed by thermal decomposition in oven under forced air ventilation at 500° C. for 10–15 minutes and subsequent natural cooling at ambient temperature.

EXAMPLE 2

18 samples made of titanium were prepared according to the invention following the procedures described above. The compositions of the interlayer and surface coatings are illustrated in Table 2.1.

TABLE 2.1

| | Interlayer | | | Surface coatings | | |
|---|---|---|---|---|---|---|
| Sample code | Components | % by weight as metal | $g/m^2$ as total metal | Components | % by weight as metal | $g/m^2$ as noble metal |
| 2.1 a,b,c | $Ta_2O_5$—$TiO_2$—$IrO_2$ | 44(Ta) 44((Ti) 12(Ir) | 2 | $Ta_2O_5$—$IrO_2$—$RuO_2$ | 30(Ta) 65(Ir) 5(Ru | 10 |
| 2.2 a,b,c | " | " | " | $Ta_2O_5$—$IrO_2$—$RuO_2$ | 35(Ta) 50(Ir) 15(Ru) | " |
| 2.3 a,b,c | " | " | " | $Ta_2O_5$—$IrO_2$—$RuO_2$ | 35(Ta) 32.5(Ir) 32.5(Ru) | " |
| 2.4 a,b,c | " | " | " | $Ta_2O_5$—$IrO_2$—$RuO_2$ | 35(Ta) 15(Ir) 50(Ru) | " |
| 2.5 a,b,c | " | " | " | $Ta_2O_5$—$TiO_2$—$IrO_2$—$RuO_2$ | 17.5(Ta) 12.5(Ti) 35(Ir) 35(Ru) | " |
| 2.6 a,b,c | " | " | " | $Ta_2O_5$—$TiO_2$—$IrO_2$—$RuO_2$ | 20(Ta) 10(Ti) 60(Ir) 10(Ru) | " |

The interlayers and surface coatings of Table 2.1 were obtained by thermal treatment starting from paints containing precursors as described in Table 2.2.

TABLE 2.2

| Sample code | Composition of the paints used for obtaining the interlayers and surface coatings: Interlayer Components | mg/ml as metal | Surface coating Components | mg/ml as metal |
|---|---|---|---|---|
| 2.1 a,b,c | $TiCl_3$ | 5.00 | $TaCl_5$ | 39 |
| | $TaCl_5$ | 5.00 | $IrCl_3$ | 85 |
| | $IrCl_3$ | 1.36 | $RuCl_3$ | 6.5 |
| | HCl | 110 | HCl | 110 |
| 2.2 a,b,c | " | | $TaCl_5$ | 45.5 |
| | | | $IrCl_3$ | 65 |
| | | | $RuCl_3$ | 19.5 |
| | | | HCl | 110 |
| 2,3 a,b,c | " | | $TaCl_5$ | 45.5 |
| | | | $IrCl_3$ | 42.3 |
| | | | $RuCl_3$ | 42.3 |
| | | | HCl | 110 |
| 2,4 a,b,c | " | | $TaCl_5$ | 45.5 |
| | | | $IrCl_3$ | 19.5 |
| | | | $RuCl_3$ | 65 |
| | | | HCl | 110 |
| 2.5 a,b,c | " | | $TaCl_5$ | 20 |
| | | | $TiCl_3$ | 14.3 |
| | | | $IrCl_3$ | 40 |
| | | | $RuCl_3$ | 40 |
| | | | HCl | 110 |
| 2.6 a,b,c | " | | $TaCl_5$ | 22.9 |
| | | | $TiCl_3$ | 11.4 |
| | | | $IrCl_3$ | 69 |
| | | | $RuCl_3$ | 11.4 |
| | | | HCl | 110 |

The samples thus prepared were subjected to electrochemical anodic characterization in three types of electrolytes, each one simulating industrial operating conditions as shown in Table 2.3.

TABLE 2.3

Electrochemical characterization: description of the tests.

| Test code | Samples: Sample code | Operating Conditions: Electrolyte | | Operating parameters | Simulated industrial process |
|---|---|---|---|---|---|
| M | present invention: from 2.1a → 2.6a references: A1,B1,C1 | $H_2SO_4$ | 150 g/l | 500 A/m$^2$ | zinc (above 90% of the worldwide electrolytic production) |
| | | $F^-$ | 50 ppm | 40° C. | |
| | | $Mn^{2+}$ | 5 g/l | | |
| N | present invention: from 2.1b → 2.6b references: A2,B2,C2 | $H_2SO_4$ | 150 g/l | 500 A/m$^2$ | zinc (the remaining 10% of the worldwide electrolytic production) |
| | | $F^-$ | 5 ppm | 40° C. | |
| | | $Mn^{2+}$ | 5 g/l | | |
| O | present invention: from 2.1c → 2.6c references: A3,B3,C3 | $Na_2SO_4$ | 100 g/l | 500 A/m$^2$ | cobalt |
| | | $H_2SO_4$ | (pH = 2–3) | 40° C. | |
| | | $Mn^{2+}$ | 20 g/l | | |

The electrochemical characterization comprised the determination of the electrode potential as a function of the working time (expressed in the normal hydrogen reference electrode scale as Volt (NHE)) and visual inspection of the sample at the end of the test.

The results obtained are summarized in table 2.4

TABLE 2.4

Electrochemical characterization: Experimental results.

| Test code | Sample code | Potential (V(NHE)) initial | 100 h | 1000 h | 3000 h | Morphological observations at the end of the test |
|---|---|---|---|---|---|---|
| | 2.1a | 1.70 | 1.72 | 1.90 | ≧3.0 | $MnO_2$ compact deposit |
| | 2.2a | 1.68 | 1.70 | 1.95 | ≧2.5 | " |
| | 2.3a | 1.65 | 1.68 | 1.90 | ≧2.2 | " |
| | 2.4a | 1.62 | 1.75 | ≧2.5 | | " |
| | 2.5a | 1.64 | 1.65 | 1.67 | 1.65 | $MnO_2$ partial coverage: spontaneous removal |
| | 2.6a | 1.68 | 1.72 | 1.74 | 1.75 | $MnO_2$ partial coverage: spontaneous removal |
| | A1 | 1.69 | 1.85 | 2.10 | ≧3.0 | $MnO_2$ compact deposit |
| | B1 | 1.72 | 1.82 | 2.10 | ≧3.0 | " |
| | C1 | 1.72 | 1.70 | 1.95 | ≧3.0 | " |
| N | 2.1b | 1.65 | 1.70 | 1.90 | ≧2.5 | $MnO_2$ compact deposit |
| | 2.2b | 1.63 | 1.66 | 1.85 | ≧2.2 | " |
| | 2.3b | 1.60 | 1.62 | 1.80 | ≧2.0 | " |
| | 2.4b | 1.58 | 1.70 | ≧2.0 | | " |
| | 2.5b | 1.62 | 1.64 | 1.65 | 1.65 | $MnO_2$ partial coverage: spontaneous removal |
| | 2.6b | 1.64 | 1.65 | 1169 | 1.69 | $MnO_2$ partial coverage: spontaneous removal |
| | A2 | 1.65 | 1.72 | 2.00 | ≧2.8 | $MnO_2$ compact deposit |
| | B2 | 1.69 | 1.80 | 2.11 | ≧3.0 | " |
| | C2 | 1.68 | 1.70 | 1.90 | ≧2.5 | " |
| O | 2.1c | 1.80 | 1.85 | 2.10 | ≧3.0 | $MnO_2$ compact deposit |
| | 2.2c | 1.76 | 1.78 | 2.00 | ≧2.5 | " |
| | 2.3c | 1.75 | 1.74 | 1.90 | ≧2.2 | " |
| | 2.4c | 1.70 | 1.72 | ≧4.00 | | " |
| | 2.5c | 1.72 | 1.74 | 1.70 | 1.75 | $MnO_2$ partial coverage: spontaneous removal |
| | 2.6c | 1.74 | 1.75 | 1.77 | 1.80 | $MnO_2$ partial coverage: spontaneous removal |

TABLE 2.4-continued

Electrochemical characterization: Experimental results.

| Test code | Sample code | Potential (V(NHE)) initial | 100 h | 1000 h | 3000 h | Morphological observations at the end of the test |
|---|---|---|---|---|---|---|
| | A3 | 1.80 | 1.95 | ≧2.2 | | $MnO_2$ compact deposit |
| | B3 | 1.84 | 1.95 | ≧203 | | " |
| | C3 | 1.78 | 1.90 | ≧2.3 | | " |

The analysis of the experimental data leads to the following observations:

- the prior art coatings are irreversibly passivated by the manganese present in the electrolyte, after about 1000 hours of operation in simulated industrial conditions;
- the presence of ruthenium in the electrocatalytic surface coating together with iridium and tantalum improves the behaviour of the electrode with respect to manganese without however eliminating the inconveniences. In fact, only a delay with time of the passivation phenomena is experienced, delay which depends on the ruthenium content in the active layer. In particular, an optimum concentration (=35%) is observed, which corresponds to longer lifetimes;
- the concurrent presence of ruthenium and titanium in the surface coating together with iridium and tantalum permits to obtain an electrochemical system durable with time and not passivated by manganese.

EXAMPLE 3

Following the same procedures described above, 18 samples made of titanium were prepared with a second type of surface coating of the invention containing ruthenium, iridium, titanium and tantalum as major components, (for a total of 90–95%), cobalt and tin as minor components (for a total of 5–10% max.). The compositions of the interlayers and surface coatings are reported in Table 3.1

TABLE 3.1

| | Interlayers | | | Coatings | | |
|---|---|---|---|---|---|---|
| Sample code | Components | % by weight as metal | g/m² as total metal | Components | % by weight as metal | g/m as noble metal |
| 3.1 a,b,c | $Ta_2O_5$—$TiO_2$ $IrO_2$ | 44(Ta) 44(Ti) 12(Ir) | 2 | $Ta_2O_5$—$TiO_2$ $IrO_2$—$RuO_2$ $CoO_x$ | 17.5(Ta) 17.5(Ti) 32(Ir) 32(Ru) I(Co) | 10 |
| 3.2 a,b,c | " | " | ‘ | " | 17.5(Ta) 17.5(Ti) 31.25(Ir) 31.25(Ru) 2.5(Co) | " |
| 3.3 a,b,c | " | " | " | " | 17.5(Ta) 17.5(Ti) 30(Ir) 30(Ru) 5(Co) | " |
| 3.4 a,b,c | " | " | " | – | 17.5(Ta) 17.5(Ti) 27.5(Ir) 27.5(Ru) 10(Co) | " |
| 3.5 a,b,c | " | " | " | $Ta_2O_5$—$TiO_2$ $IrO_2$—$RuO_2$ $CoO_x$ $SnO_x$ | 15(Ta) 10(Ti) 35(Ir) 35(Ru) 2.5(Co) 2.5(Sn) | " |
| 3.6 a,b,c | " | " | " | " | 15(Ta) 10(Ti) 33.75(Ir) 33.75(Ru) 2.5(Co) 5(Sn) | " |

The interlayers and surface coatings of Table 3.1 have been obtained by thermal treatment starting from paints of precursor salts as illustrated in Table 3.2.

TABLE 3.2

| | Composition of the paints used for obtaining the interlayers and surface coatings | | | |
|---|---|---|---|---|
| Sample | Interlayer | | Surface Coating | |
| code | Components | mg/ml as metal | Components | mg/ml as metal |
| 3.1.a,b,c | $TiCl_3$ | 5.00 | $TaCl_5$ | 24.2 |
| | $TaCl_5$ | 5.00 | $TiCl_3$ | 24.2 |
| | $IrCl_3$ | 1.36 | $IrCl_3$ | 45 |
| | HCl | 110 | $RuCl_3$ | 45 |
| | | | $CoCl_2$ | 1.4 |

TABLE 3.2-continued

| | Composition of the paints used for obtaining the interlayers and surface coatings | | | |
|---|---|---|---|---|
| Sample | Interlayer | | Surface Coating | |
| code | Components | mg/ml as metal | Components | mg/ml as metal |
| | | | HCl | 110 |
| 3.2.a,b,c | " | " | $TaCl_5$ | 25.2 |
| | | | $TiCl_3$ | 25.2 |
| | | | $IrCl_3$ | 45 |
| | | | $RuCl_3$ | 45 |
| | | | $CoCl_2$ | 3.6 |
| | | | HCl | 110 |
| 3.3.a,b,c | " | " | $TaCl_5$ | 26.3 |
| | | | $TiCl_3$ | 26.3 |
| | | | $IrCl_3$ | 45 |
| | | | $RuCl_3$ | 45 |
| | | | $CoCl_2$ | 7.5 |
| | | | HCl | 110 |
| 3.4.a,b,c | " | " | $TaCl_5$ | 25.5 |
| | | | $TiCl_3$ | 25.5 |
| | | | $IrCl_3$ | 40 |
| | | | $RuCl_3$ | 40 |
| | | | $CoCl_2$ | 14.5 |
| | | | HCl | 110 |
| 3.5.a,b,c | " | " | $TaCl_5$ | 17.1 |
| | | | $TiCl_3$ | 11.4 |
| | | | $IrCl_3$ | 40 |
| | | | $RuCl_3$ | 40 |

TABLE 3.2-continued

| | Composition of the paints used for obtaining the interlayers and surface coatings | | | |
|---|---|---|---|---|
| Sample | Interlayer | | Surface Coating | |
| code | Components | mg/ml as metal | Components | mg/ml as metal |
| | | | $CoCl_2$ | 2.8 |
| | | | $SnCl_4$ | 2.8 |
| | | | HCl | 110 |
| 3.6.a,b,c | " | " | $TaCl_5$ | 17.3 |
| | | | $TiCl_3$ | 11.5 |
| | | | $IrCl_3$ | 38.9 |
| | | | $RuCl_3$ | 38.9 |
| | | | $CoCl_2$ | 2.9 |

TABLE 3.2-continued

| Sample code | Composition of the paints used for obtaining the interlayers and surface coatings: Interlayer Components | Interlayer mg/ml as metal | Surface Coating Components | Surface Coating mg/ml as metal |
|---|---|---|---|---|
| | | | $SnCl_4$ | 5.7 |
| | | | HCl | 110 |

The samples thus prepared have been subjected to anodic electrochemical characterization in 3 types of electrolyte, each one simulating industrial operating conditions as shown in Table 3.3.

TABLE 3.3

Electrochemical characterization: description of the tests.

| Test code | Sampling: Sample code | Operating Conditions: Electrolyte | | Operating parameters | Simulated Industrial Process |
|---|---|---|---|---|---|
| M | present invention: from 3.1a → 3.6a references: A4,B4,C4 | $H_2SO_4$ $F^-$ $Mn^{2+}$ | 150 g/l 50 ppm 5 g/l | 500 A/m$^2$ 40° C. | zinc (above 90% of the worldwide electrolytic production) |
| N | present invention: from 3.1b → 3.6b references: A5,B5,C5 | $H_2SO_4$ $F^-$ $Mn^{2+}$ | 150 g/l 5 ppm 5 g/l | 500 A/m$^2$ 40° C. | zinc (the remaining 10% of the worldwide electrolytic production) |
| O | present invention: from 3.1c → 3.6c references: A6,B6,C6 | $Na_2SO_4$ $H_2SO_4$ $Mn^{2+}$ | 100 g/l (pH = 2–3) 20 g/l | 500 A/m$^2$ 40° C. | cobalt |

The characterization comprised the determination of the electrode potential as a function of the working time and visual inspection of the sample at the end of the test.

The results obtained are summarized in table 3.4.

TABLE 3.4

Electrochemical characterization: Experimental results.

| Test code | Sample code | Potential (V(NHE)) initial | 100 h | 1000 h | 3000 h | Morphological observations at the end of the test |
|---|---|---|---|---|---|---|
| M | 3.1a | 1.65 | 1.65 | 1.68 | 1.72 | $MnO_2$ partial coverage: spontaneous removal |
| | 3.2a | 1.64 | 1.65 | 1.67 | 1.68 | $MnO_2$ partial coverage: spontaneous removal |
| | 3.3a | 1.60 | 1.63 | 1.65 | 1.69 | $MnO_2$ partial coverage: spontaneous removal |
| | 3.4a | 1.58 | 1.62 | 1.65 | 1.65 | $MnO_2$ partial coverage: spontaneous removal |
| | 3.5a | 1.62 | 1.60 | 1.55 | 1.58 | $MnO_2$ partial coverage: spontaneous removal |
| | 3.6a | 1.64 | 1.62 | 1.64 | 1.68 | $MnO_2$ partial coverage: spontaneous removal |
| | A4 | 1.69 | 1.85 | 2.20 | ≧3.0 | $MnO_2$ compact deposit |
| | B4 | 1.72 | 1.80 | 1.95 | ≧3.0 | " |
| | C4 | 1.68 | 1.75 | 1.90 | ≧3.0 | " |
| N | 3.1b | 1.60 | 1.62 | 1.60 | 1.64 | $MnO_2$ partial coverage: spontaneous removal |
| | 3.2b | 1.62 | 1.60 | 1.62 | 1.70 | $MnO_2$ partial coverage: spontaneous removal |

TABLE 3.4-continued

Electrochemical characterization: Experimental results.

| Test code | Sample code | Potential (V(NHE)) initial | 100 h | 1000 h | 3000 h | Morphological observations at the end of the test |
|---|---|---|---|---|---|---|
| | 3.3b | 1.58 | 1.60 | 1.62 | 1.65 | $MnO_2$ partial coverage: spontaneous removal |
| | 3.4b | 1.55 | 1.58 | 1.65 | 1.75 | $MnO_2$ partial coverage: spontaneous removal |
| | 3.5b | 1.60 | 1.62 | 1.58 | 1.63 | $MnO_2$ partial coverage: spontaneous removal |

TABLE 3.4-continued

Electrochemical characterization: Experimental results.

| Test code | Sample code | Potential (V(NHE)) initial | 100 h | 1000 h | 3000 h | Morphological observations at the end of the test |
|---|---|---|---|---|---|---|
| | 3.6b | 1.62 | 1.64 | 1.70 | 1.74 | $MnO_2$ partial coverage: spontaneous removal |
| | A5 | 1.65 | 1.80 | 2.20 | ≧2.8 | $MnO_2$ compact deposit |
| | B5 | 1.70 | 1.75 | 1.90 | ≧3.0 | " |
| | C5 | 1.65 | 1.70 | 1.90 | ≧2.5 | " |
| O | 3.1c | 1.75 | 1.77 | 1.77 | 1.80 | $MnO_2$ partial coverage: spontaneous removal |
| | 3.2c | 1.72 | 1.72 | 1.74 | 1.75 | $MnO_2$ partial coverage: spontaneous removal |
| | 3.3c | 1.68 | 1.64 | 1.68 | 1.70 | $MnO_2$ partial coverage: spontaneous removal |
| | 3.4c | 1.64 | 1.65 | 1.67 | 1.65 | $MnO_2$ partial coverage: spontaneous removal |
| | 3.5c | 1.70 | 1.68 | 1.70 | 1.72 | $MnO_2$ partial coverage: spontaneous removal |
| | 3.6c | 1.65 | 1.67 | 1.68 | 1.70 | $MnO_2$ partial coverage: spontaneous removal |
| | A6 | 1.80 | 2.0 | ≧2.3 | | $MnO_2$ compact deposit |
| | B6 | 1.85 | 2.1 | ≧2.4 | | " |
| | C6 | 1.75 | 1.90 | ≧2.3 | | " |

The analysis of the data of table 3.4 leads to the following observations:

the prior art coatings are irreversibly passivated by the manganese present in the electrolyte after about 1000 hours of operation at simulated industrial conditions;

the presence of cobalt, in the system comprising ruthenium, iridium, tantalum (already examined in previous Example 2) further decreases the electrode potential, mainly at the beginning of the operation;

the concurrent presence of cobalt and tin in the above system not only decreases the initial electrode potential but furthermore causes its stabilization with time.

EXAMPLE 4

6 samples made of titanium have been prepared following the aforementioned procedure, without any interlayer, with the 4- or 6-component surface coatings selected among the best from the tests of the previous examples. The compositions of the surface coatings are given in Table 4.1.

TABLE 4.1

| | Interlayers | | | Coatings | | |
|---|---|---|---|---|---|---|
| Sample code | Components | % by weight as metal | $g/m^2$ as total metal | Components | % by weight as metal | g/m as noble metal |
| 4.1 a,b,c | / | / | / | $Ta_2O_5$—$TiO_2$<br>$IrO_2$—$RuO_2$ | 17.5(Ta) 12.5(Ti)<br>35(Ir) 35(Ru) | 10 |
| 4.2 a,b,c | / | / | / | $Ta_2O_5$—$TiO_2$<br>$IrO_2$—$RuO_2$<br>$CoO_x$—$SnO_x$ | 12.5(Ta) 12.5(Ti)<br>35(Ir) 35(Ru)<br>2.5(Co) 2.5(Sn) | |

The surface coatings of Table 4.1 were obtained by thermal treatment from paints of precursor salts as shown in Table 4.2.

TABLE 4.2

| Compositions of the paints used for preparing the surface coatings of Table 4.1 | | |
|---|---|---|
| Sample code | Components | mg/ml |
| 4.1.a,b,c | $TaCl_5$<br>$TiCl_3$ | 17.1<br>17.1 |

TABLE 4.2-continued

| Compositions of the paints used for preparing the surface coatings of Table 4.1 | | |
|---|---|---|
| Sample code | Components | mg/ml |
| 4.2.a,b,c | $IrCl_3$<br>$RuCl_3$<br>HCl<br>$TaCl_5$<br>$TiCl_3$<br>$IrCl_3$<br>$RuCl_3$<br>$CoCl_2$ | 40<br>40<br>110<br>14.3<br>14.3<br>40<br>40<br>2.9 |

TABLE 4.2-continued

| Compositions of the paints used for preparing the surface coatings of Table 4.1 | | |
|---|---|---|
| Sample code | Components | mg/ml |
| | $SnCl_4$<br>HCl | 2.9<br>110 |

The samples thus prepared were subjected to anodic electrochemical characterization in 3 types of electrolytes, each one simulating the industrial operating as shown in table 4.3.

TABLE 4.3

| Electrochemical characterization: description of the tests. | | | | |
|---|---|---|---|---|
| Test code | Sampling Sample code | Operating Conditions Electrolyte | Operating parameters | Simulated industrial process |
| M | present invention: from 4.1a → 4.2a 2.5a (Example 2), 3.5a (Example 3), references: A7,B7,C7. | $H_2SO_4$ 150 g/l<br>$F^-$ 50 ppm<br>$Mn^{2+}$ 5 g/l | 500 $A/m^2$<br>40° C. | zinc (above 90% of the worldwide electrolytic production) |
| N | present invention: from 4.1b → 4.2b 2.5b (Example 2), 3.5b (Example 3), references: A8,B8,C8. | $H_2SO_4$ 150 g/l<br>$F^-$ 5 ppm<br>$Mn^{2+}$ 5 g/l | 500 $A/m^2$<br>40° C. | zinc (the remaining 10% of the worldwide electrolytic production) |
| O | present invention: from 4.1c → 4.2c 2.5c (Example 2), 3.5c (Example 3), references: A9,B9,C9. | $Na_2SO_4$ 100 g/l<br>$H_2SO_4$ (pH = 2–3)<br>$Mn^{2+}$ 20 g/l | 500 $A/m^2$<br>40° C. | cobalt |

The characterization comprising the determination of the electrode potential as a function of the working time and visual inspection of the sample at the end of the test, gave the experimental results summarized in 4.4.

TABLE 4.4

Electrochemical characterization: Experimental results.

| Test code | Sample code | Potential (V(NHE)) initial | 100 h | 1000 h | 3000 h | Morphological observations at the end of the test |
|---|---|---|---|---|---|---|
| M | 4.1a | 1.67 | 1.68 | 1.70 | 1.74 | $MnO_2$ partial coverage: spontaneous removal |
| | 4.2a | 1.66 | 1.68 | 1.67 | 1.70 | $MnO_2$ partial coverage: spontaneous removal |
| | A7 | 1.69 | 1.85 | 2.20 | ≧3.0 | $MnO_2$ compact deposit |
| | B7 | 1.72 | 1.80 | 2.20 | ≧3.0 | " |
| | C7 | 1.68 | 1.75 | 1.90 | ≧3.0 | " |
| | 2.5a (Example 2) | 1.64 | 1.65 | 1.67 | 1.65 | $MnO_2$ partial coverage: spontaneous removal |
| | 3.5a (Example 3) | 1.62 | 1.60 | 1.55 | 1.58 | $MnO_2$ partial coverage: spontaneous removal |
| N | 4.1b | 1.67 | 1.70 | 1.70 | 1.74 | $MnO_2$ partial coverage: spontaneous removal |
| | 4.2b | 1.65 | 1.68 | 1.72 | 1.70 | $MnO_2$ partial coverage: spontaneous removal |
| | A8 | 1.65 | 1.80 | 2.20 | ≧2.8 | $MnO_2$ partial coverage: spontaneous removal |
| | B8 | 1.70 | 1.75 | 1.90 | ≧3.0 | $MnO_2$ partial coverage: spontaneous removal |
| | C8 | 1.65 | 1.70 | 1.90 | ≧2.5 | $MnO_2$ partial coverage: spontaneous removal |
| | 2.5b (Example 2) | 1.62 | 1.64 | 1.65 | 1.65 | $MnO_2$ partial coverage: spontaneous removal |
| | 3.5b (Example 3) | 1.60 | 1.62 | 1.58 | 1.63 | $MnO_2$ partial coverage: spontaneous removal |
| O | 4.1c | 1.78 | 1.75 | 1.80 | 1.80 | $MnO_2$ partial coverage: spontaneous removal |
| | 4.2c | 1.74 | 1.70 | 1.75 | 1.78 | $MnO_2$ partial coverage: spontaneous removal |
| | A9 | 1.80 | 2.00 | ≧2.20 | | $MnO_2$ compact deposit |
| | B9 | 1.85 | 2.10 | ≧2.30 | | " |
| | C9 | 1.75 | 1.90 | ≧2.30 | | " |
| | 2.5c (Example 2) | 1.72 | 1.74 | 1.70 | 1.75 | $MnO_2$ partial coverage: spontaneous removal |
| | 3.5c (Example 3) | 1.70 | 1.68 | 1.70 | 1.72 | $MnO_2$ partial coverage: spontaneous removal |

From the analysis of the experimental results it is possible to make the following observations:

the prior art coatings are irreversibly passivated by manganese present in the electrolyte after about 1000 hour of simulated industrial conditions.

the coatings of the present invention, without any interlayer, although operating at slightly higher potentials with respect to those typical of anodes provided with the interlayer are equally stable to fluorides and are not passivated by manganese.

What is claimed is:

1. An anode for oxygen evolution in acid electrolytes containing sulfuric acid and high quantities of manganese and optionally fluorides in small quantities, said anode comprising a titanium matrix provided with a surface electrocatalytic coating, wherein said surface electrocatalytic coating consists of pure oxides or mixed oxides of the metals of the group consisting of titanium, tantalum, tin, cobalt, ruthenium and iridium, wherein ruthenium and iridium are major components, cobalt and tin are minor components and titanium and tantalum are components present in intermediate quantities.

2. The anode of claim 1 wherein ruthenium and iridium are present as a total by weight comprised between 30 and 90%, titanium and tantalum are present as a total by weight between 30 and 40%, cobalt and tin are present as a total by weight comprised between 1 and 10%.

3. The anode of claim 2 wherein the amount of cobalt and tin is 4 to 6%.

4. The anode of claim 1 characterized in that it further comprises a conductive interlayer between said matrix and said electrocatalytic coating, having the function of protection against fluorides.

5. A method for preparing the anode of claim 1, characterized in that it comprises the following steps:

corindone sandblasting of the titanium matrix, pickling in hydrochloric acid, optionally formation of a protective interlayer by applying paints containing thermally decomposable compounds of the metals of the platinum group, and metals of the groups IV B and V B, with drying and thermal decomposition in air, with the repetition of the steps of application, drying, decomposition up to obtaining a desired thickness, formation of the surface electrocatalytic coating by applying paints containing thermally decomposable compounds of at least one noble metal selected from the group of ruthenium and iridium, at least one valve metal selected from the group of titanium and tantalum and at least one non-noble metal selected from the group of cobalt and tin, with drying and thermal decomposition in air, with the repetition of the steps of application, drying, decomposition up to obtaining the desired thickness.

6. The process of claim 5 wherein the platinum group metal is iridium and the metals of group IV B and V B are titanium and tantalum and the non-noble metal is tin and/or cobalt.

7. In the process of electrodepositing a metal from an aqueous solution containing ions of said metal, magnesium ions and optionally fluoride ions by electrolysis of the solution between an anode and a cathode, the improvement comprising using an anode of claim 1.

8. The method of claim 7 wherein the ions are of zinc or cobalt.

* * * * *